US010981222B2

(12) United States Patent
Morikawa et al.

(10) Patent No.: US 10,981,222 B2
(45) Date of Patent: Apr. 20, 2021

(54) CASTING METHOD FOR ACTIVE METAL

(71) Applicant: Kobe Steel, Ltd., Kobe (JP)

(72) Inventors: Yuzo Morikawa, Hyogo (JP); Daisuke Matsuwaka, Hyogo (JP); Hitoshi Ishida, Hyogo (JP); Shushi Ikeda, Tokyo (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 16/468,499

(22) PCT Filed: Dec. 5, 2017

(86) PCT No.: PCT/JP2017/043660
§ 371 (c)(1),
(2) Date: Jun. 11, 2019

(87) PCT Pub. No.: WO2018/110370
PCT Pub. Date: Jun. 21, 2018

(65) Prior Publication Data

US 2019/0299281 A1 Oct. 3, 2019

(30) Foreign Application Priority Data

Dec. 13, 2016 (JP) ..... JP2016-241248
Oct. 25, 2017 (JP) ..... JP2017-206165

(51) Int. Cl.
*B22D 7/00* (2006.01)
*B22D 21/06* (2006.01)
(Continued)

(52) U.S. Cl.
CPC ..... *B22D 21/06* (2013.01); *B22D 7/00* (2013.01); *B22D 7/005* (2013.01); *B22D 13/00* (2013.01);
(Continued)

(58) Field of Classification Search
CPC ..... B22D 7/00; B22D 7/005; B22D 21/06; B22D 27/04; F27B 14/06; F27B 14/061
See application file for complete search history.

(56) References Cited

U.S. PATENT DOCUMENTS 5,372,355 A * 12/1994 Henn ..... B22D 41/20 222/602
2003/0089481 A1* 5/2003 Moore ..... F27D 99/0006 164/250.1
(Continued)

FOREIGN PATENT DOCUMENTS

DE 3026721 A1 * 2/1982 ..... F27B 14/10
JP 8-132182 A 5/1996
(Continued)

OTHER PUBLICATIONS

EPO machine translation of JP 11-310833 (Year: 1999).*
(Continued)

*Primary Examiner* — Kevin E Yoon
(74) *Attorney, Agent, or Firm* — Oblon, McClelland, Maier & Neustadt, L.L.P.

(57) ABSTRACT

A casting method of an active metal includes, in an induction melting furnace using a water-cooled crucible, tapping a molten metal into a mold from a tapping hole provided at a bottom of the water-cooled copper crucible to cast an ingot of the active metal. In conducting the casting under a casting condition in which the ingot has a diameter (D) of 10 mm or more and a ratio (H/D) of an ingot height H to the ingot diameter D of 1.5 or more and a weight of the molten metal tapped in the casting is 200 kg or less, a temperature of the molten metal in the casting is set to be higher than the melting point of the active metal and a casting velocity V (mm/sec) is controlled to satisfy V≤0.1H in relation with the ingot height H by adjusting an opening diameter of the tapping hole.

4 Claims, 4 Drawing Sheets

(51) Int. Cl.

| | |
|---|---|
| ***B22D 27/04*** | (2006.01) |
| ***B22D 13/00*** | (2006.01) |
| ***B22D 18/06*** | (2006.01) |
| ***F27B 14/06*** | (2006.01) |
| *F27B 14/08* | (2006.01) |

(52) U.S. Cl.
CPC ..... *B22D 18/06* (2013.01); *B22D 27/04* (2013.01); *F27B 14/06* (2013.01); *F27B 14/061* (2013.01); *F27B 2014/0837* (2013.01)

(56) References Cited

U.S. PATENT DOCUMENTS

| | | | | |
|---|---|---|---|---|
| 2013/0156637 | A1* | 6/2013 | Park | B22D 27/20 420/591 |
| 2017/0113270 | A1* | 4/2017 | Schwenkel | C21C 5/5252 |

FOREIGN PATENT DOCUMENTS

| | | | |
|---|---|---|---|
| JP | 9-57422 | A | 3/1997 |
| JP | 11-745 | A | 1/1999 |
| JP | 11-57984 | A | 3/1999 |
| JP | 11-87044 | A | 3/1999 |
| JP | 11-310833 | A | 11/1999 |
| JP | 2003-311376 | A | 11/2003 |
| JP | 2006-122920 | A | 5/2006 |
| JP | 2006-281291 | A | 10/2006 |
| JP | 2009-113063 | A | 5/2009 |
| UA | 6858 | C2 | 3/1995 |

OTHER PUBLICATIONS

EPO machine translation of JP 11-000745 (Year: 1999).*

International Search Report dated Feb. 6, 2018 in PCT/JP2017/043660 (with English translation), citing documents AO through AS therein, 4 pages.

Written Opinion of the International Searching Authority dated Feb. 6, 2018 in PCT/JP2017/043660 (with English translation), citing documents AO through AS therein, 8 pages.

Extended European Search Report dated Apr. 20, 2020 in European Patent Application No. 17880176.7, citing documents AO and AP therein, 8 pages.

* cited by examiner

PRIOR ART

PRIOR ART

CASTING METHOD FOR ACTIVE METAL

TECHNICAL FIELD

The present invention relates to a casting method of an active metal, capable of obtaining a small-diameter ingot in good quality and high yield.

BACKGROUND ART

In an induction melting furnace using a water-cooled copper crucible (CCIM: cold crucible induction melting apparatus), impurities are hardly mixed into a molten metal from a melting atmosphere and the crucible and it is therefore suitable for the melting of an active metal, particularly the melting of a metal having high melting point.

Furthermore, the induction melting furnace can melt raw materials in the furnace without restriction of a shape so long as the raw materials have a size smaller than a crucible size. Therefore, materials such as scraps can be effectively used as raw materials.

Furthermore, electromagnetic induction which causes heating in the induction melting furnace also causes electromagnetic repulsion for stirring a molten metal. Therefore, homogeneity in the molten metal can be maintained by the stirring due to the electromagnetic repulsion.

For this reason, the casting of an active metal using an induction melting furnace is considered to be an effective method for obtaining high-quality ingot in high yield, since good yield is required in casting an ingot of an active metal because of high raw material cost.

A density of a metal in a solid state is typically larger than a density of the metal in a liquid state, and therefore, a volume of a casting body is decreased when the cast body solidifies. In other words, a cavity called a shrinkage cavity is generated as a defect in casting in a part at which a cooling rate is relatively low and solidification is delayed because of shrinkage in solidification. The shrinkage cavity is easily generated in an axial center part of an ingot, particularly when a small-diameter ingot is produced.

Therefore, when a metal melted in an induction melting furnace is cast as a small-diameter ingot, a method such as a centrifugal casting method or a vacuum casting method is typically used in order to reduce the shrinkage cavity when casting.

For example, Patent Literature 1 discloses a method for conducting vacuum casting using a casting apparatus equipped with a closed holding furnace and a mold connected to the holding furnace by a supply sleeve. The vacuum casting method of Patent Literature 1 makes it possible to sufficiently reduce the pressure in a cavity (in the holding furnace) and also makes it possible to fill a molten metal in laminar flow. Therefore, there is no possibility to involve air and the quality of casting is enhanced. Furthermore, in the vacuum casting method of Patent Literature 1, it is considered that the difference between the pressure in the holding furnace and the pressure in the cavity can be increased and as a result, casting weight is not restricted and large amount casting is possible.

Furthermore, a directional solidification method as shown in Patent Literature 2 is known as the method for preventing the generation of a shrinkage cavity as described above.

In detail, Patent Literature 2 discloses a precise solidification method including heating the upper part of a ceramic mold to a temperature higher than that of the lower part thereof using a heating furnace divided into a plurality in a height direction and capable of individually adjusting the temperature, pouring a molten metal in the heated ceramic mold and conducting solidification. In the precise solidification method of Patent Literature 2, the lower part of the mold is heated to relatively low temperature and the upper part of the mold is heated to high temperature in the heating furnace having temperature distribution in a height direction. When the molten metal is then poured into the mold, directional solidification that the molten metal gradually solidifies toward the upper part from the lower part (bottom side at which the temperature of the molten metal is low) occurs in the mold. It is considered that when the directional solidification occurs, the generation of defects such as a shrinkage cavity can be prevented.

The conventional casting method by an induction melting furnace using a water-cooled copper crucible typically employs a tapping method of tilting the crucible. However, a method of tapping from the bottom of a crucible as shown in Patent Literature 3 has been proposed.

In detail, the casting method of Patent Literature 3 has a configuration in which a material to be melted in a crucible is floated by electromagnetic repulsion and melted by induction heating, and the molten metal is tapped into the mold from a tapping hole at the bottom.

Cylindrical conductive adaptor is exchangeably fitted to the tapping hole, and in the casting method of Patent Literature 3, tapping flow rate can be stepwise adjusted by exchanging the adaptor.

CITATION LIST

Patent Literature

Patent Literature 1: JP-A-H9-57422
Patent Literature 2: JP-A-H11-57984
Patent Literature 3: JP-A-H11-87044

SUMMARY OF INVENTION

Technical Problem

The vacuum casting method of Patent Literature 1 requires an extra step for reducing a pressure in a holding furnace, and the step of reducing a pressure is additionally required. This leads to the deterioration of productivity due to the increase of step in casting.

The deterioration of productivity due to the increase of step is the same in a centrifugal casting method in which a shrinkage cavity is reduced by applying centrifugal force to a mold.

Furthermore, the precise solidification method of Patent Literature 2 requires newly arranging a heating furnace capable of heating by changing the temperature in a height direction. In addition, the heating temperature needs to be finely changed in a height direction in casting. As a result, the production process tends to be complicated and this may lead to the increase of the production cost.

Furthermore, the bottom-tapping type melting furnace of Patent Literature 3 greatly changes tapping flow rate by changing the diameter of the tapping hole in the bottom tapping. However, the patent literature does not contain the description regarding the effect on the yield of the ingot or the quality when the tapping flow rate is changed, nor the description regarding the casting of a small-diameter material to be melted.

The present invention has been made in view of the above problems, and has an object to provide a casting method of active metal which realizes directional solidification from the bottom of an ingot in a mold into which molten metal is poured, reduces a shrinkage cavity inside the ingot and improves the yield of non-defective product, by using a crucible which is composed of water-cooled copper and the like and which is induction-heating type and bottom-tapping type and controlling a pouring rate of a molten metal in casting.

Solution to Problem

To solve the above problems, the casting method of active metal of the present invention takes the following technical means.

The casting method of active metal of the present invention is a casting method of an active metal including, in an induction melting furnace using a water-cooled crucible, tapping a molten metal into a mold from a tapping hole provided at a bottom of the water-cooled copper crucible to cast an ingot of the active metal, wherein in conducting the casting under a casting condition in which the ingot has a diameter (D) of 10 mm or more and a ratio (H/D) of an ingot height H to the ingot diameter D of 1.5 or more and a weight of the molten metal tapped in the casting is 200 kg or less, a temperature of the molten metal in the casting is set to be higher than the melting point of the active metal and the casting is conducted while a casting velocity V (mm/sec) that is a velocity at which the casting proceeds in the mold is controlled to satisfy $V \leq 0.1H$ in relation with the ingot height H by adjusting an opening diameter of the tapping hole.

Advantageous Effects of Invention

According to the casting method of active metal of the present invention, directional solidification from the bottom of an ingot can be realized in a mold into which molten metal is poured, shrinkage cavity in the inside of the ingot can be reduced and the yield of non-defective product can be improved, by using a crucible constituting of water-cooled copper and the like and which is induction-heating type and bottom-tapping type and controlling a tapping velocity of a molten metal in casting.

DESCRIPTION OF EMBODIMENTS

The embodiment of the casting method of active metal according to the present invention is described in detail below by reference to the drawings.

The casting method of active metal of this embodiment produces a small-diameter ingot S (ingot) by pouring a molten metal M obtained by melting an active metal having high melting point (hereinafter referred to as active metal) such as titanium (Ti)-based, zirconium (Zr)-based, vanadium (V)-based or chromium (Cr)-based alloy into a mold 4 and conducting casting.

Casting equipment 1 used in the casting method of active metal of this embodiment is described below.

Figure 1A:
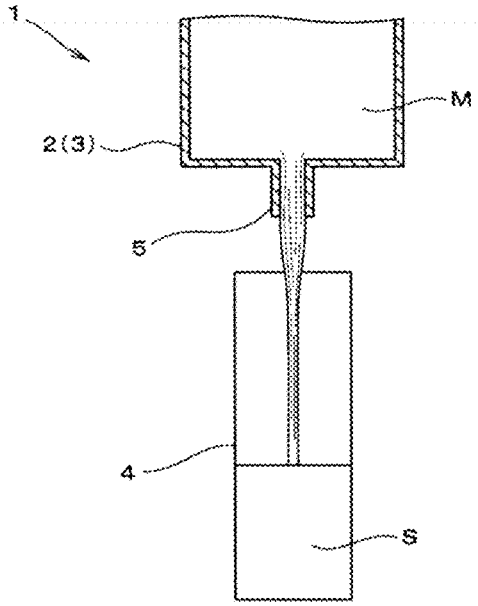
FIG. 1A illustrates a casting equipment used in a melting method of active metal of this embodiment.

As illustrated in FIG. 1, the casting equipment 1 of this embodiment has an induction melting furnace 3 using a water-cooled copper crucible 2 and a mold 4 into which a molten metal M tapped from the bottom of the crucible 2 is poured. The molten metal M is tapped into the mold 4 from the bottom of the crucible 2 and a small-diameter ingot S of the active metal is cast.

The induction melting furnace 3 used in the casting equipment 1 of this embodiment generates induction current inside a material to be melted and utilizes its resistance heating, and is generally called Cold Crucible Induction Melting. The induction melting furnace 3 melts the active metal using the water-cooled copper crucible 2. The crucible 2 is formed of copper without using a refractory which is frequently used as a material constituting the crucible 2 of a typical melting furnace. For this reason, the induction melting furnace is difficult to receive the influence of contaminants from the refractory.

The crucible 2 used in the above-described induction melting furnace 3 is formed into a bottomed cylindrical shape opened upward as illustrated in FIG. 1, and can store the molten active metal thereinside.

A wall of the crucible 2 is formed of copper as described above, and is cooled with water. When the wall of the crucible 2 is formed of such a water-cooled copper, the temperature of the wall of the crucible 2 does not increase to a predetermined temperature (for example, 250° C.) or higher even when the crucible stores the molten active metal. Specifically, even when the molten active metal is placed in the water-cooled copper crucible 2, a solidified shell called skull is formed between the wall of the crucible 2 and the molten metal and plays a role as a crucible. As a result, the molten metal is not contaminated by the crucible 2.

The crucible 2 of this embodiment is bottom-tapping type, and a tapping hole 5 capable of guiding the stored active metal downward is formed at the bottom of the crucible 2. The tapping hole 5 is configured so that its opening diameter is adjustable and therefore the amount of the molten metal M to be guided downward is adjustable. The tapping hole 5 may be configured so that the opening diameter is adjusted by an electromagnetic method or a mechanical method, or may be configured so that a plurality of valve members having different opening diameter is previously prepared and the opening diameter is adjusted by exchanging the valve member.

The mold 4 is formed into a bottomed cylindrical shape opened upward.

Inner dimension of the mold 4 preferably has a size within the following applicable range, when the diameter of the ingot S is D, the height of the ingot S is H and the weight of the molten metal M is W:

Ingot diameter D (mm): $10 \leq D \leq 150$

Ingot height H (mm): $15 \leq H \leq 1500$

Molten metal weight (kg): $0.2 \leq W \leq 200$

Procedures of casting active metal using the above-described induction melting furnace 3, in other words, the casting method of active metal, are described below.

The casting method of active metal of this embodiment a method including, in an induction melting furnace 3 using a water-cooled crucible 2, tapping a molten metal M into a mold 4 from a bottom of the water-cooled copper crucible 2 to cast a small-diameter ingot S of the active metal. In this case, the casting of the small-diameter ingot S is conducted under the casting condition in which the diameter (D) is 10 mm or more, a ratio (H/D) of the height (H) of the ingot S to the diameter (D) of the ingot S is 1.5 or more, and the weight of the molten metal M tapped in the casting is 200 kg or less. In conducting the casting, the tapping hole 5 configured so that its opening diameter is adjustable is provided at the bottom of the crucible 2. The temperature of the molten metal M in casting is set to a temperature higher than the melting point of the active metal and the casting is conducted while a casting velocity V (mm/sec) which is a velocity at which the casting proceeds in the mold 4 is controlled to satisfy $V \leq 0.1H$ in relation with the ingot height H by adjusting the opening diameter of the tapping hole 5. As a result, the shrinkage cavity inside the ingot S is reduced and the casting yield is improved. In order to prevent "molten metal clogging" in which the molten metal tapped in casting is clogged and does not flow, the temperature of the molten metal M in casting is preferably higher than the melting point of the active material by 20° C. or more, more preferably by 40° C. or more.

The reasons for setting the above casting conditions in the casting method of this embodiment are as follows.

Figure 5A:
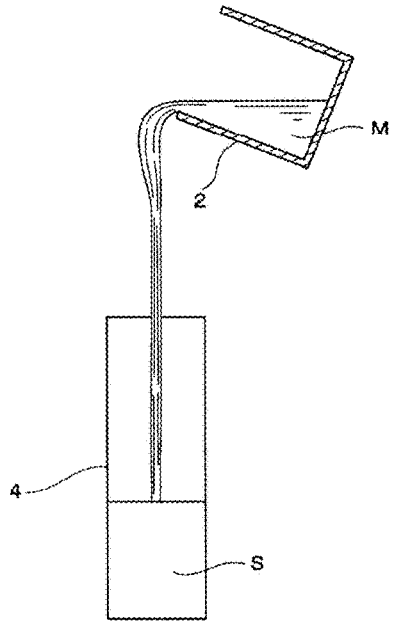
FIG. 5A is a view of a casting equipment used in the conventional melting method (tilting-tapping method) of active metal.
Figure 5B:
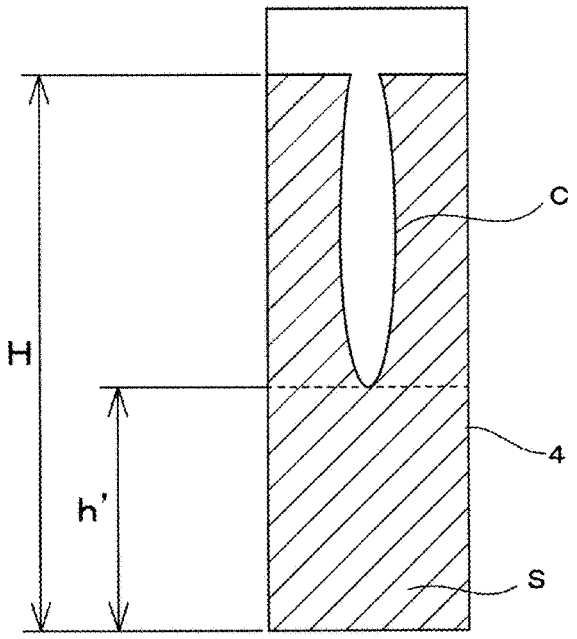
PRIOR ART FIG. 5B
FIG. 5B is a schematic cross-sectional view of the inside of an ingot cast by the casting apparatus of FIG. 5A.

For example, a multicomponent Ti—Al alloy raw material (Ti-33.3Al-4.6Nb-2.55Cr) is melted in the induction melting furnace 3 of the water-cooled copper crucible 2 (size: diameter 250 mm) and maintained until reaching a completely molten state. Thereafter, current was applied to a coil arranged at the bottom, a titanium bottom plug (size: diameter 3.2 mm) arranged at the bottom was induction-melted, and the bottom plug was melted and removed to form an opening. The molten alloy raw material was tapped from the bottom of the crucible 2 in a bottom-tapping method to cast the ingot S. In comparison, an ingot was prepared by conducting a tilting type tapping as illustrated in FIG. 5A and FIG. 5B. Cross-sectional photographs of the ingot S sample of the Ti—Al alloys cast as above are illustrated in the left side of FIG. 2 regarding the tilting-tapping method (conventional technology) and in the right side of FIG. 2 regarding the bottom-tapping method (present invention).

Figure 1B:
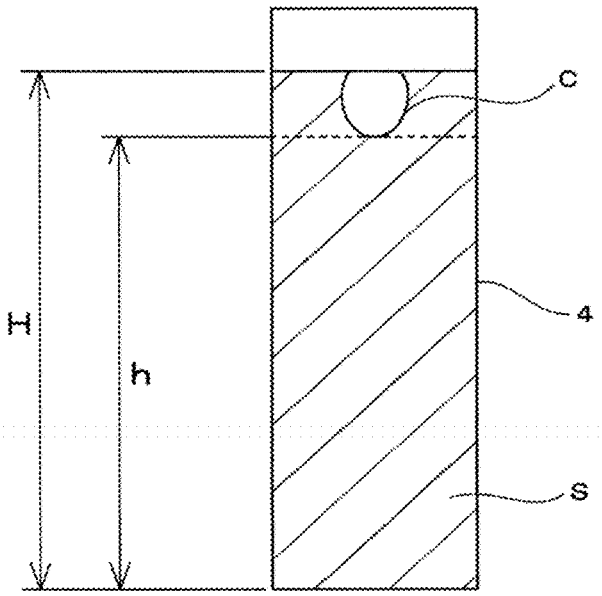
FIG. 1B is a schematic cross-sectional view of the inside of an ingot cast by the casting apparatus of FIG. 1A.
Figure 2:
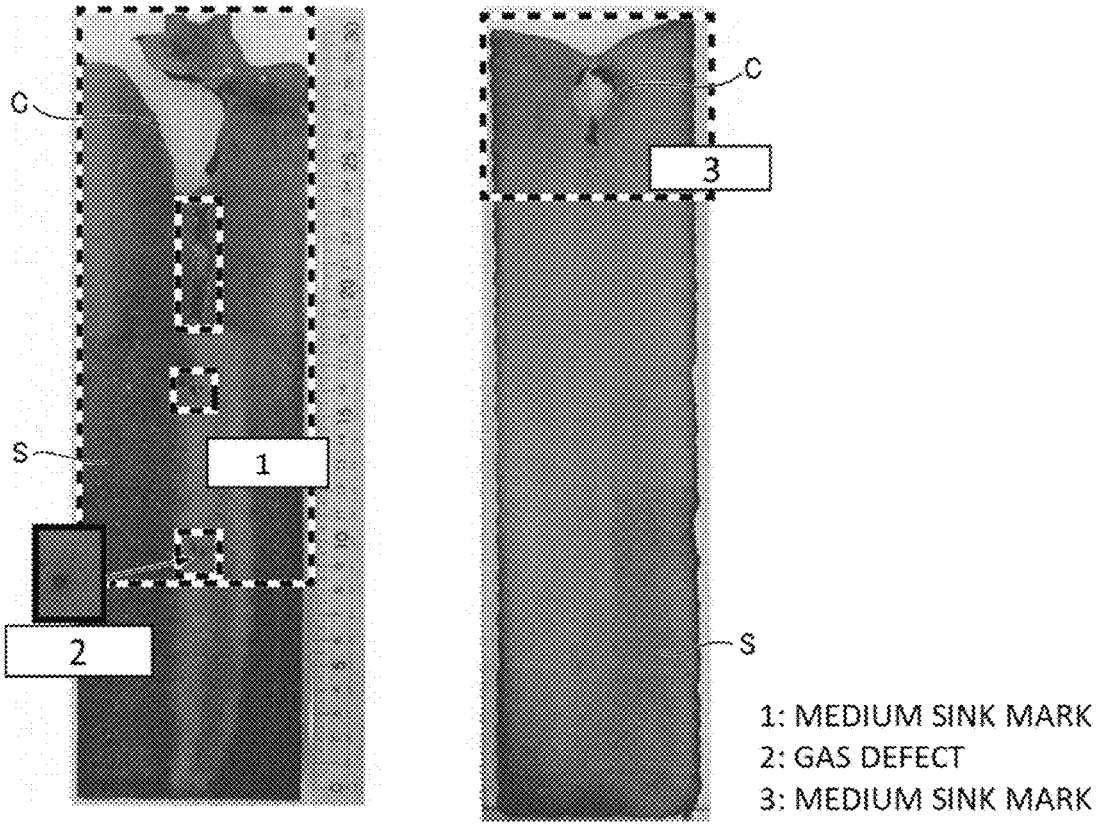
In FIG. 2, the left view is a cross-sectional view of the generation state of the defect inside an ingot cast by the conventional melting method (tilting-tapping method), and the right view is a cross-sectional view of the generation state of the defect inside an ingot cast by the melting method of this embodiment.

As illustrated in the left side of FIG. 2, defects by the shrinkage cavity C are apparently present over a wide range of a vertical direction inside the ingot S cast by the conventional tilting-tapping method. On the other hand, it was confirmed that the defects by the shrinkage cavity C were generated at only the upper end part of the ingot S inside the ingot S cast by the bottom-tapping as illustrated in the right side of FIG. 2. The reason for this is considered that when the molten alloy raw material was tapped by the bottom-tapping method, the casting velocity became slow as compared with the tilting-tapping method, and as a result, the finally solidified part constituted the uppermost part though a solidification process close to the directional solidification from the bottom. Although not illustrated in FIG. 1B and FIG. 5B, the defects called "medium sink mark" confined in the ingot are included in the shrinkage cavity C.

The evaluating results of the generation state of the shrinkage cavity inside the ingots S by the bottom-tapping method and the tilting-tapping method and the yields are shown in Table 1.

TABLE 1

| Art | Casting velocity | Shrinkage cavity | Yield of non-defective product | Evaluation |
|---|---|---|---|---|
| Conventional example (Tilting-tapping method) | 3.6 kg/s | X | 30% | X |
| Present example (Bottom-tapping method) | 0.05 kg/s | ○ | 80% | ○ |

As is understood from the present example of Table 1, by slowing down the casting velocity as compared with the conventional example, the generation place of the shrinkage cavity C shifts to the upper end side of the ingot S (TOP part of ingot S), and the "yield of non-defective product" is improved up to 80% in the present example (bottom-tapping method) as compared with 30% in the conventional example (tilting-tapping method). The "yield of non-defective product" represents a ratio of a height of a place which the shrinkage cavity C is not present inside the ingot S, that is, the place at which the shrinkage cavity S is not generated in FIG. 2, to an overall height of the ingot S (specifically, h/H in FIG. 1B and h'/H in FIG. 5B).

The occurrence of difference of the generation state of the shrinkage cavity C as the above is greatly affected by the position of the finally solidified part present in the ingot S. In other words, basically the shrinkage cavity C is greatly generated in the place at which the solidification is completed (finally solidified part). Therefore, when the casting velocity has been changed using numerical analysis software, if the temperature distribution inside the ingot S is obtained, the position at which the finally solidified part is present in the ingot S is also obtained, and the generation state of the shrinkage cavity C is evaluated.

Figure 3:
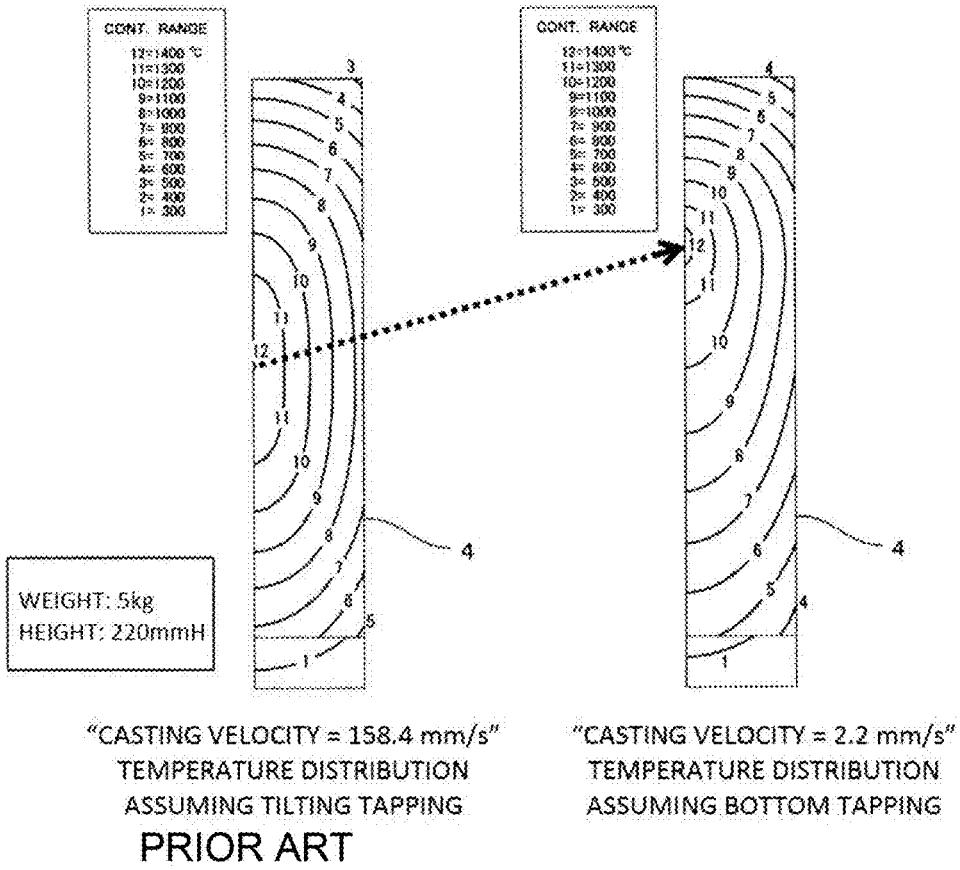
In FIG. 3, the left view illustrates a temperature distribution inside an ingot having a weight of 5 kg and a height of 220 mm cast in a casting rate of 158.4 mm/sec and the right view illustrates a temperature distribution inside an ingot having a weight of 5 kg and a height of 220 mm cast in a casting rate of 2.2 mm/sec.

For example, the left side of FIG. 3 illustrates the temperature distribution inside the ingot S when the casting has been conducted by the tilting-tapping method (conventional art). Numerical values in the figure indicate the temperature inside the ingot S obtained as a result of numerical analysis. It shows that the temperature of ingot piece is high as the numerical value is large, and the finally solidified part that is not solidified until the final and remains has high temperature. In other words, it is assumed that the finally solidified part corresponds to the generation place at which the shrinkage cavity C is mainly generated.

As illustrated in the left side of FIG. 3, when the tilting-tapping method is supposed, that is, when the casting velocity is high as 158.4 mm/s, the generation place of the shrinkage cavity C is present at the central part (central side in vertical direction) of the ingot S.

On the other hand, as illustrated in the right side of FIG. 3, when the bottom-tapping method (the art of the present invention) is supposed, that is, when the casting velocity is slow as 2.2 mm/sec, it is confirmed that the generation place of the shrinkage cavity C has shifted to the upper end side of the ingot S. This is considered to be due to that by decreasing the casting velocity, the directional solidification in which the solidification proceeds in order upward from the bottom is realized.

Figure 4:
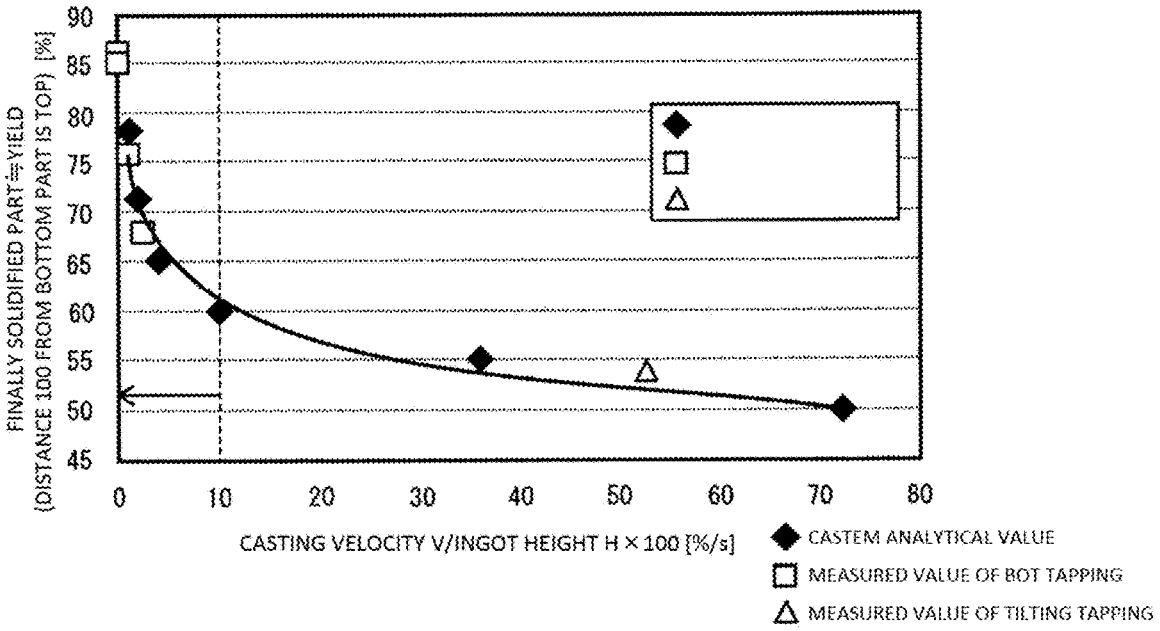
FIG. 4 illustrates the influence of a casting rate on the yield of an ingot.

The relationship between the casting velocity and the position of the finally solidified part (generation place of the shrinkage cavity C) is shown in Table 2 and FIG. 4. The mold such that an ingot having a diameter (D) of 100 mm and a weight of 25 kg is obtained was used.

TABLE 2

| Art | | Casting velocity V (kg/s) | Casting velocity V/ Ingot height H × 100 (%/s) | Yield of non-defective product (%) |
|---|---|---|---|---|
| Example | CASTEM analytical value | 4.80 | 72 | 50 |
| | | 2.40 | 36 | 55 |
| | | 0.67 | 10 | 60 |
| | | 0.27 | 4 | 65 |
| | | 0.13 | 2 | 71.5 |
| | | 0.07 | 1 | 78 |
| | Measured value of BOT tapping | 0.15 | 2.26 | 68 |
| | | 0.05 | 0.75 | 76 |
| | | 0.066 | 0.0047 | 86 |
| | | 0.067 | 0.0059 | 85 |
| Comparative Example | Measured value of tilting tapping | 3.60 | 52.9 | 54 |

FIG. 4 shows the position of the finally solidified part (in other words, yield of the ingot S) when the casting velocity to the weight of the ingot S (casting velocity [%/sec] represented by a ratio to casting length) has been changed. The casting velocity of CASTEM analytical value shown in FIG. 4 is calculated using the numerical value analysis as same as in FIG. 3. The casting velocity of the experimental value of the bottom tapping and the experimental value of the tilting tapping is obtained by the experiment. When the height of the ingot S in FIG. 1B is H (mm), in case where the casting velocity V (mm/s) is "0.1×H" or less ("casting velocity (mm/s)/ingot height (mm)×100" is 10%/s or less), the finally solidified part shifts to the upper end side (TOP part) of the ingot S and the shrinkage cavity C also shifts to the upper end side of the ingot S. As a result, in case where the casting velocity V is "0.1×H" or less, the part excluding the upper end side at which the shrinkage cavity C is generated can be used as non-defective ingot S and it is assumed that the yield of the non-defective product is improved to 60% or more. According to the Example of FIG. 4, when casting velocity V (mm/s)/ingot height (mm)×100 is 4%/s or less, the yield is improved to 65% or more; when casting velocity V (mm/s)/ingot height (mm)×100 is 2%/s or less, the yield is improved to 70% or more; when casting velocity V (mm/s)/ingot height (mm)×100 is 1%/s or less, the yield is improved to 75% or more; and when casting velocity V (mm/s)/ingot height (mm)×100 is 0.006%/s or less, the yield is improved to 85% or more.

In the case of the conventional method (tilting-tapping method), the yield of the non-defective product is merely 30% in the case of Table 1 and is merely 54% in the case of Table 2.

Therefore, in order that the yield of the non-defective product is 60% or more, the casting velocity V (mm/sec) is preferably "0.1×H" or less when the height of the ingot S is H (mm).

The reasons for setting the above-described casting conditions in the casting method of this embodiment are described as above.

That is, in the present invention, in conducting the casting under the casting condition in which the diameter (D) is 10 mm or more, the ratio (H/D) of the height H of the ingot S to the diameter D of the ingot S is 1.5 or more and the weight of the molten metal tapped in casting is 200 kg or less, the casting is conducted such that the temperature of the molten metal M in casting is set to higher than the melting point of the active metal by 40° C. or more and the casting velocity V (mm/sec) is controlled to satisfy V≤0.1H. Thus, the shrinkage cavity C inside the ingot S is reduced and the casting yield is improved.

It should be considered that the embodiments disclosed herein are examples in all respects and are not limitative. In particular, items not explicitly disclosed, for example, operating conditions, various parameters, and size, weight and volume of constructs, do not deviate from the ranges in which one skilled in the art generally carries out, and values that can be easily anticipated by one skilled in the art can be used.

Although the present invention has been described in detail and by reference to the specific embodiments, it is apparent to one skilled in the art that various modifications or changes can be made without departing the spirit and scope of the present invention.

This application is based on Japanese Patent Application No. 2016-241248 filed on Dec. 13, 2016 and Japanese Patent Application No. 2017-206165 filed on Oct. 25, 2017, the disclosures of which are incorporated herein by reference.

INDUSTRIAL APPLICABILITY

The present invention can produce high-quality ingot having less shrinkage cavity in high yield in the ingot production of active metal by an induction melting furnace.

REFERENCE SIGNS LIST

1 Casting equipment
2 Crucible
3 Induction melting furnace
4 Mold
5 Tapping hole
C Shrinkage cavity
M Molten metal
S Ingot

The invention claimed is:

1. A casting method of an active metal, the method comprising:

in an induction melting furnace using a water-cooled crucible, tapping a molten metal into a mold from a tapping hole provided at a bottom of the water-cooled copper crucible, thereby casting an ingot of the active metal, wherein the casting is conducted under a casting condition in which the ingot has a diameter (D) of at least 10 mm and a ratio (H/D) of an ingot height H to the ingot diameter D of at least 1.5, and a weight of the molten metal tapped in the casting is 200 kg or less, and wherein a temperature of the molten metal in the casting is higher than a melting point of the active metal and the casting is conducted while a casting velocity V (mm/sec) that is a velocity at which the casting proceeds in the mold is controlled to satisfy V≤0.1H in relation to the ingot height H by adjusting an opening diameter of the tapping hole.

2. The method of claim 1, wherein the active metal is at least one selected from the group consisting of a titanium (Ti)-based, zirconium (Zr)-based, vanadium (V)-based, and chromium (Cr)-based alloy.

3. The method of claim 1, wherein a yield of a non-defective ingot in the bottom-tapping method is up to 80%, wherein the yield of a non-defective ingot represents a ratio h/H of a height h of a place where a shrinkage cavity C is not generated inside the ingot to a height H of the ingot.

4. The method of claim 2, wherein a yield of a non-defective ingot in the bottom-tapping method is up to 80%, wherein the yield of a non-defective ingot represents a ratio h/H of a height h of a place where a shrinkage cavity C is not generated inside the ingot to a height H of the ingot.

* * * * *